US006142218A

United States Patent [19]

Nilsson et al.

[11] Patent Number: 6,142,218

[45] Date of Patent: Nov. 7, 2000

[54] ARRANGEMENT AT THE INLET PIPE TO THE HEAT EXCHANGER UNIT IN A FLUE-GAS TUBE

[75] Inventors: Håkan Nilsson, Järfälla; Wilhelm Sabelström, Bromma, both of Sweden

[73] Assignee: Aalborg Industries A/S, Denmark

[21] Appl. No.: 08/930,328

[22] PCT Filed: Dec. 30, 1996

[86] PCT No.: PCT/SE96/01761

§ 371 Date: Apr. 19, 1999

§ 102(e) Date: Apr. 19, 1999

[87] PCT Pub. No.: WO97/27427

PCT Pub. Date: Jul. 31, 1997

[30] Foreign Application Priority Data

Jan. 26, 1996 [SE] Sweden ..... 9600298

[51] Int. Cl.[7] ..... F28F 7/00; F28D 7/10

[52] U.S. Cl. ..... 165/82; 165/81; 165/154

[58] Field of Search ..... 165/81, 82, 181, 165/154

[56] References Cited

U.S. PATENT DOCUMENTS

| | | | |
|---|---|---|---|
| 1,326,277 | 12/1919 | Latourelle | 165/82 |
| 2,961,221 | 11/1960 | Friese et al. | 165/82 X |
| 3,026,092 | 3/1962 | Pellegrini | 165/81 |
| 3,572,430 | 3/1971 | Charnock, Jr. | 165/82 |
| 3,989,100 | 11/1976 | McDonald | 165/81 |
| 4,276,928 | 7/1981 | Blaskowski | 165/82 |
| 5,626,187 | 5/1997 | Nilsson | 165/181 X |

FOREIGN PATENT DOCUMENTS

| | | | |
|---|---|---|---|
| 848282 | 9/1960 | United Kingdom | 165/81 |

*Primary Examiner*—Leonard Leo
*Attorney, Agent, or Firm*—Ostrolenk, Faber, Gerb & Soffen, LLP

[57] ABSTRACT

A heat-exchanger unit (13) for recovering heat from the flue gases from a cylinder steam boiler (10), said heat exchanger unit comprising a flue-gas tube (14) and a heat-exchanging tube (16) which is supported concentrically inside the flue-gas tube (14) by a bent inlet pipe (19) extending from a lower opening (20) in the peripheral wall of the flue-gas tube (14) to an inlet opening (21) in a lower outwardly bulging end wall (22) of the heat-exchanging tube (16), and an outlet pipe (23) extending from an outlet opening (24) in an upper part of the peripheral wall of the heat-exchanging tube (16) to an upper opening (25) in the peripheral wall of the flue-gas tube (14). The inlet pipe (19) has a first, horizontal, straight end portion (19A), a second, upwardly directed, straight end portion (19B) and also an intermediate, curved portion (19C). The bending angle ($\alpha$) of the curved portion exceeds 90° and the other end portion (19B) extends with an inclination determined by said bending angle ($\alpha$), towards the center of curvature of a partially spherical portion of the lower end wall (22) of the heat-exchanging tube (16), in which wall the inlet opening (21) is arranged eccentrically in relation to the central longitudinal axis of the heat-exchanging tube (16).

4 Claims, 3 Drawing Sheets

ARRANGEMENT AT THE INLET PIPE TO THE HEAT EXCHANGER UNIT IN A FLUE-GAS TUBE

Figure 1:
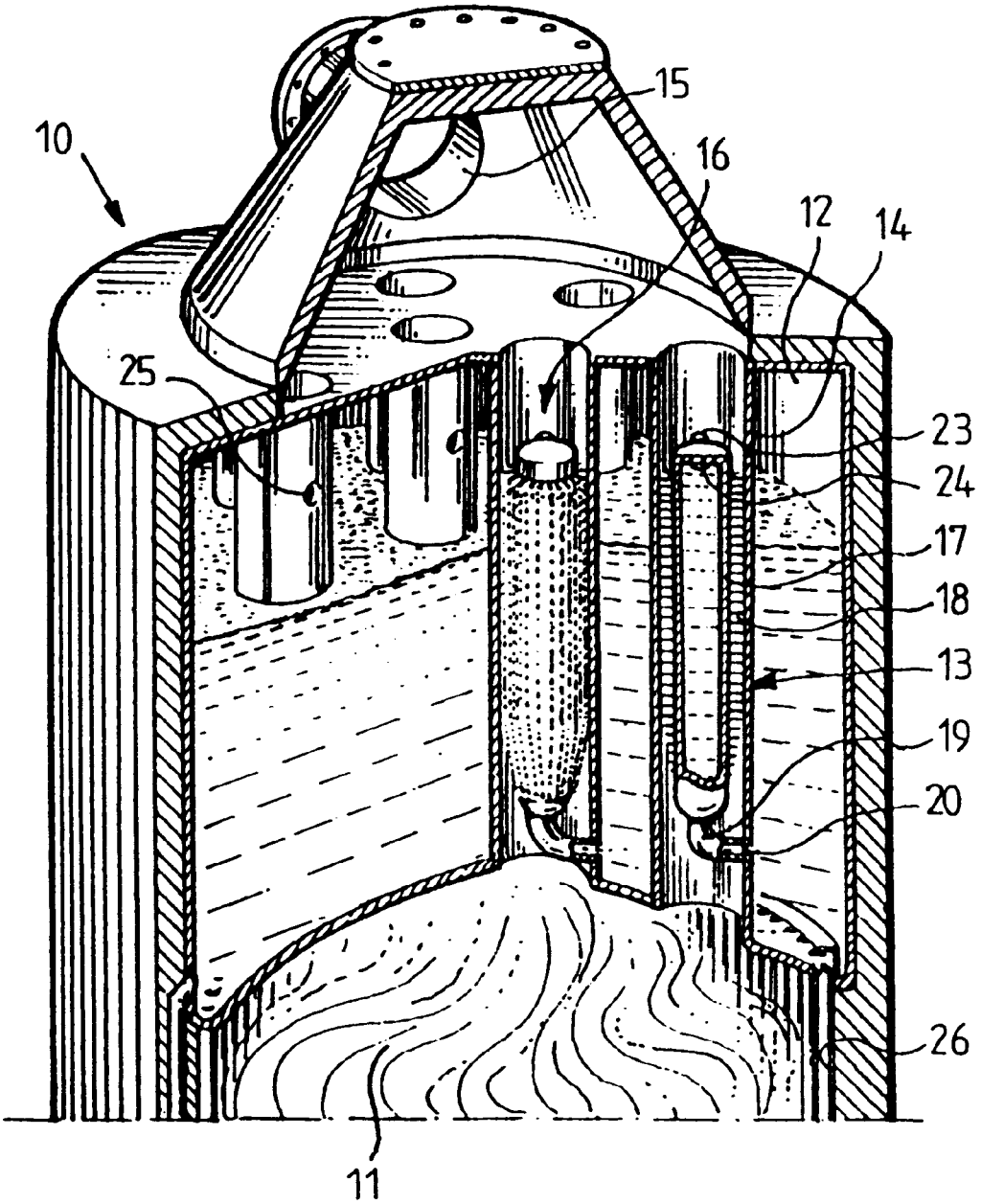

The present invention relates to a heat-exchanger unit for recovering heat from the flue gases from a cylinder steam boiler.

More specifically the invention relates to a heat exchanger unit of the type comprising a flue-gas tube open at both ends for fitting in vertical position in a pressure vessel situated above the boiler's combustion appliance in order to form a flue-gas channel running vertically therethrough, and a heat-exchanging tube dosed at both ends which is supported concentrically inside the flue-gas tube at one end by a bent inlet pipe extending from a first lower opening in the peripheral wall of the flue-gas tube to an inlet opening in a lower outwardly bulging end wall of the heat-exchanging tube and at the other end by a straight outlet pipe extending from an outlet opening in an upper part of the peripheral wall of the heat-exchanging tube to a second, upper opening in the peripheral wall of the flue-gas tube, the inlet pipe having a first, horizontal, straight end portion by which it is connected to the flue-gas tube, and a second, upwardly directed, straight end portion by which it is connection to the lower end wall of the heat-exchanging tube, and also an intermediate, curved portion joining said two end portions together.

In previously known heat exchanger units of the type described above the curved portion of the inlet pipe has always been bent at an angle of 90°. Furthermore, the other end portion of the inlet pipe has extended in strictly vertical direction towards the inlet opening, the latter being arranged concentrically in relation to the central longitudinal axis of the heat-exchanging tube in the lower end wall of the heat-exchanging tube.

A drawback of these known heat exchanger units has been that cracks can easily occur at the weld between inlet pipe and flue-gas tube. The reason for this cracking is that the hot flue gases produced in the boiler's combustion appliance subjects the heat-exchanging tube to considerably greater thermal influence than the flue-gas tube which means that, when the boiler is in operation, the heat-exchanging tube undergoes considerably greater longitudinal expansion than the flue-gas tube. This is particularly so when, as is usually the case, the heat-exchanging tube is provided with external surface-enlarging elements in the form of a large number of pins protruding radially from the tubular body of the heat-exchanging tube, for instance. Since the outlet pipe is normally considerably shorter than the inlet pipe and also generally considerably greater in diameter, this difference in the longitudinal expansion between heat-exchanging tube and flue-gas tube will give rise to considerably higher mechanical strain at the joint between inlet pipe and flue-gas tube than at the joint between outlet pipe and flue-gas tube. The risk of fatigue cracks eventually appearing is therefore much greater in the former joint than in the latter.

The object of the invention is to obtain an improved heat exchanger unit of the type described in the introduction, with reduced risk of fatigue cracks of the type described above appearing, and therefore having increased service life in comparison with previously known heat exchanger units.

The heat exchanger unit proposed according to the invention for this purpose is characterized primarily in that the bending angle of the intermediate, curved portion of the inlet pipe exceeds 90° and that the other end portion of the inlet pipe extends with an inclination determined by said bending angle, towards the centre of curvature of a partially spherical portion of the lower end wall of the heat-exchanging tube, in which wall the inlet opening is arranged eccentrically in relation to the central longitudinal axis of the heat-exchanging tube.

Giving the bent portion of the inlet pipe a bending angle exceeding 90° achieves increased flexibility in the inlet pipe. The increased bending angle thus also results in an increase in the total length of said pipe as well as an increase in the length of the bent portion of the pipe, which is less rigid than the straight parts of the pipe as a result of having thinner wall thickness and the somewhat oval cross section caused when said portion is bent.

The proposed orientation of the other end portion of the inlet pipe and the proposed placing of the inlet opening also ensures that the inlet opening can be made completely circular and the end portion of the inlet pipe connected to this opening can be given a circular end surface perpendicular to its longitudinal direction. This therefore avoids the inlet opening of the proposed bending angle of the bent portion of the inlet pipe or the adjacent end surface of the inlet pipe requiring any special, complicated shape, and thus also avoids any increased manufacturing costs for the heat exchanger unit.

It has been established by calculation that even with a bending angle for the bent portion of the inlet pipe which is only a few degrees greater than 90°, a significant increase is obtained in the fatigue strength of the joint between the inlet pipe and the flue-gas tube. However, according to the invention said bending angle shall preferably be at least approximately 100°.

To ensure that the embodiment of the heat exchanger unit according to the invention does not entail any risk of a section appearing at the lower end of the heat-exchanging tube which cannot be drained via the inlet pipe when the boiler is taken out of operation, the central longitudinal axis of the heat-exchanging tube should preferably extend through the lower end wall of the heat-exchanging tube at a point situated inside the peripheral edge of the inlet opening.

The invention will be described in more detail in the following with reference to the accompanying drawings in which.

Figure 2:
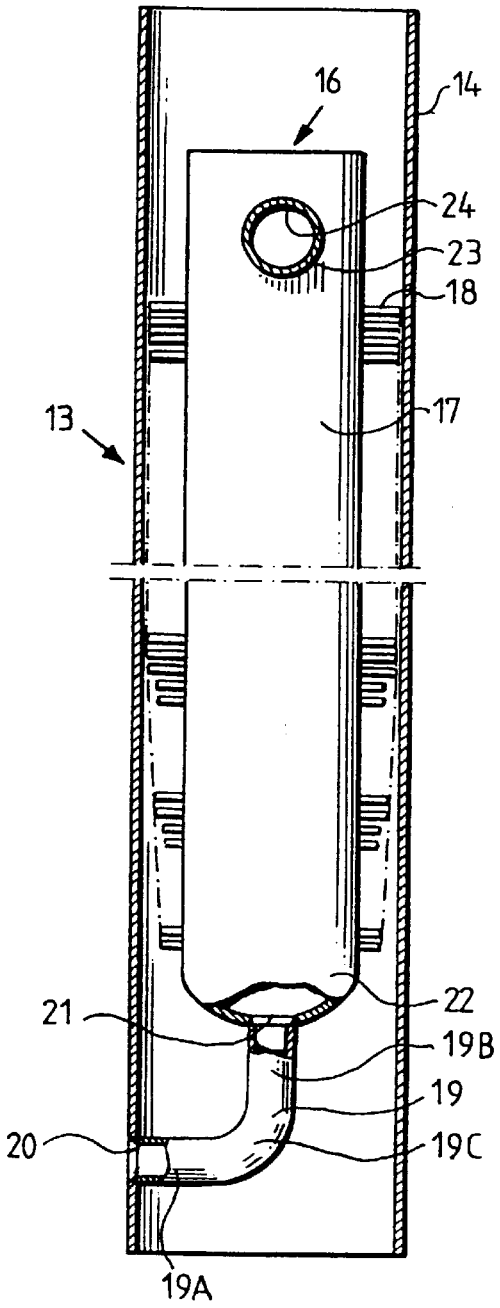
Fig. 2 PRIOR ART
Figure 3:
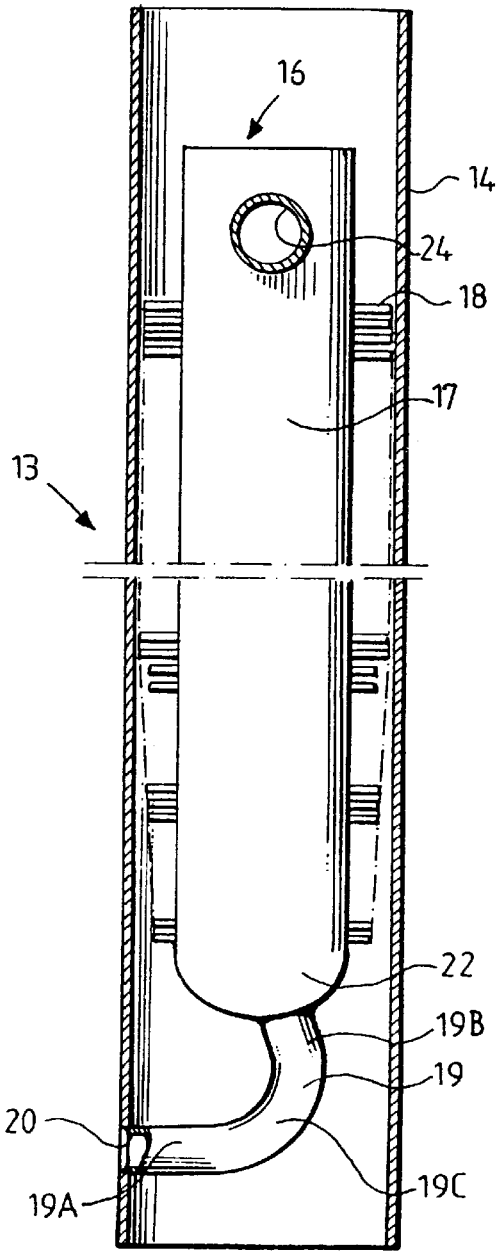
Figure 4:
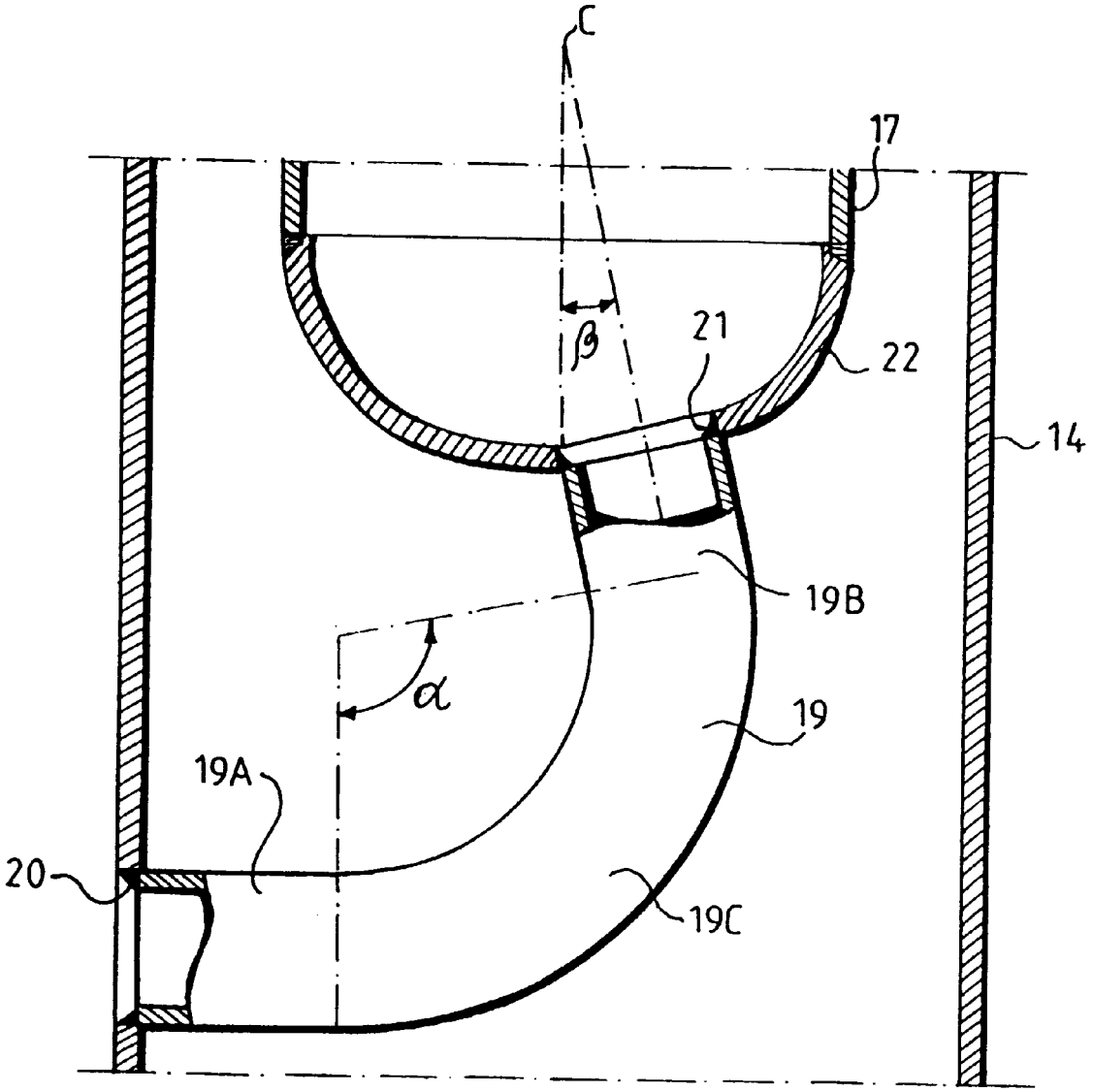

FIG. 1 shows in section part of a cylinder steam boiler provided with a number of heat exchanger units of known type, FIG. 2 shows a longitudinal section, on an enlarged scale, of one of said known heat exchanger units, FIG. 3 shows a corresponding longitudinal section of a heat exchanger unit according to an embodiment of the invention selected by way of example, and FIG. 4 shows in longitudinal section and further enlarged, a part of the lower portion of a heat exchanger unit according to FIG. 3.

In FIG. 1 a cylinder steam boiler of known design is generally designated 10. It has a combustion appliance 11 with a pressure vessel 12 situated above, forming the water and steam chamber of the boiler. A plurality of heat exchanger units, generally designated 13, are arranged in the pressure vessel 12 to recover heat from the flue gases generated in the combustion appliance.

Each heat exchanger unit 13 comprises a flue-gas tube 14, open at both ends, which is sealed to the upper and lower end walls of the pressure vessel 12 and forms a channel running vertically through this, enabling flue gases to be diverted from the combustion appliance 11 to a flue-gas outlet arranged above the pressure vessel 12. Each heat exchanger unit 13 also comprises a heat-exchanging tube, generally designated 16, which is also arranged inside the flue-gas tube and consists of a tubular body 17, closed at both ends, and a large number of radially protruding pins 18 applied externally on said body to form external surface-enlarging elements on the tube body 17.

The heat-exchanging tube 16 is supported concentrically inside the flue-gas tube 14 at one end by an inlet pipe 19 which, as can be seen most clearly in FIG. 2, extends from a lower opening 20 in the peripheral wall of the flue-gas tube to an inlet opening 21 in a lower outwardly bulging end wall 22 of the heat-exchanging tube and at the other end by an outlet pipe 23 extending from an outlet opening 24 in an upper part of the peripheral wall of the heat-exchanging tube to an upper opening 25 in the peripheral wall of the flue-gas tube.

The exact construction and function of the cylinder steam boiler 10 may be of optional known type and no detailed description is therefore necessary. It should be sufficient to mention that, with the aid of means not shown, water can be circulated continuously through passages 26 located around the combustion appliance 11 for the purpose of transferring heat from the combustion appliance to the water in the pressure vessel 12 via the walls of the combustion appliance. This water also receives heat from the flue gases passing through the flue-gas tubes 14, both as a result of heat conduction through the walls of the flue-gas tubes and with the aid of the heat-exchanging tubes 16 through which water will constantly circulate. As a result of the above-mentioned supply of heat, steam will be generated in the pressure vessel 12 and can be removed by suitable means, not shown.

As can be seen in FIG. 2, the inlet pipe 19 in the known heat exchanger unit has a first, horizontal, straight end portion 19A by which it is connected to the flue-gas tube 14, and a second, upwardly directed, straight end portion 19B by which it is connection to the lower end wall 22 of the heat-exchanging tube 16, and also an intermediate, curved portion 19C joining the two end portions 19A and 19B together. The bending angle of the curved portion 19C is exactly 90° and the other end portion 19B extends in strictly vertical direction and concentrically in relation to the central longitudinal axis of the heat-exchanging tube 16.

The heat exchanger unit according to the invention, illustrated in FIGS. 3 and 4, differs from the known heat exchanger unit illustrated in FIG. 2 only with regard to the shape of the inlet pipe 19 and the placing of the inlet opening 21 communicating therewith, in the lower end wall 22 of the heat-exchanging tube.

Whereas the curved portion of the inlet pipe in the heat exchanger unit according to FIG. 2 is bent at an angle of exactly 90°, the bent portion 19C of the inlet pipe 19 in the heat exchanger unit according to the invention illustrated in FIGS. 3 and 4 is bent at an angle $\alpha$ which is greater than 90° and which is 101° in the embodiment shown.

Furthermore, the upwardly directed, straight end portion 19B of the inlet pipe 19 according to FIGS. 3 and 4 extends with an inclination determined by the bending angle $\alpha$, towards the centre of curvature of the partially spherical portion, designated C in FIG. 4, of the lower end wall 22 of the heat-exchanging tube 16 in which the inlet opening 21 is arranged. The longitudinal axis of the straight end portion 19B thus forms an angle $\beta$ with the central longitudinal axis of the heat-exchanging tube 16. The inlet opening 21 is thus arranged eccentrically in the wall 22 in relation to the central longitudinal axis of the heat-exchanging tube 16. The angle $\beta$ has a value corresponding to the value of the angle $\alpha$ minus 90°. In the embodiment of the invention shown the angle $\beta$ is thus 11°.

To ensure that the heat-exchanging tube 16 can be drained through the inlet pipe 19 when the boiler is taken out of operation, the position of the inlet opening 21 is so chosen than the central longitudinal axis of the heat-exchanging tube extends through the wall 22 at a point situated inside the peripheral edge of the opening 21.

What is claimed is:

1. A heat-exchanger unit for recovering heat from the flue gases from a cylinder steam boiler, said heat exchanger unit comprising a flue-gas tube open at both ends for fitting in vertical position in a pressure vessel situated above the boiler's combustion appliance in order to form a flue-gas channel running vertically therethrough, and a heat-exchanging tube closed at both ends which is supported concentrically inside the flue-gas tube at one end by a bent inlet pipe extending from a first lower opening in the peripheral wall of the flue-gas tube to an inlet opening in a lower outwardly bulging end wall of the heat-exchanging tube and at the other end by a straight outlet pipe extending from an outlet opening in an upper part of the peripheral wall of the heat-exchanging tube to a second, upper opening in the peripheral wall of the flue-gas tube, the inlet pipe having a first, horizontal, straight end portion by which it is connected to the flue-gas tube, and a second, upwardly directed, straight end portion by which it is connection to the lower end wall of the heat-exchanging tube, and also an intermediate, curved portion joining said two end portions together, characterized in that the bending angle of the intermediate, curved portion of the inlet pipe exceeds 90° and that the other end portion of the inlet pipe extends with an inclination determined by said bending angle, towards the centre of curvature of a partially spherical portion of the lower end wall of the heat-exchanging tube, in which wall the inlet opening is arranged eccentrically in relation to the central longitudinal axis of the heat-exchanging tube.

2. A heat exchanger unit as claimed in claim 1, characterized in that said bending angle is at least approximately 100°.

3. A heat exchanger unit as claimed in claim 1 characterized in that the central longitudinal axis of the heat-exchanging tube extends through the lower end wall of the heat-exchanging tube at a point situated inside the peripheral edge of the inlet opening.

4. A heat exchanger unit as claimed in claim 2, characterized in that the central longitudinal axis of the heat-exchanging tube extends through the lower end wall of the heat-exchanging tube at a point situated inside the peripheral edge of the inlet opening.

* * * * *